US007911357B2

(12) United States Patent
Isac

(10) Patent No.: US 7,911,357 B2
(45) Date of Patent: Mar. 22, 2011

(54) TRICOLOR SIGNAL HOUSING

(75) Inventor: Victor Isac, Montreal (CA)

(73) Assignee: Lumination LLC, Valley View, OH (US)

( * ) Notice: Subject to any disclaimer, the term of this patent is extended or adjusted under 35 U.S.C. 154(b) by 242 days.

(21) Appl. No.: 12/006,123

(22) Filed: Dec. 31, 2007

(65) Prior Publication Data

US 2009/0168437 A1 Jul. 2, 2009

(51) Int. Cl.
*G08B 5/22* (2006.01)

(52) U.S. Cl. ..... 340/815.45; 340/815.49; 340/815.65; 118/63 R; 362/227; 362/362; 362/545

(58) Field of Classification Search ..... 340/815.45, 340/815.65, 815.69, 902, 907, 332, 815.49; 40/550, 557; 116/63, 63 R; 362/184, 185, 362/227, 257, 236, 245, 362, 800, 543, 544, 362/545

See application file for complete search history.

(56) References Cited

U.S. PATENT DOCUMENTS

| | | | | |
|---|---|---|---|---|
| 5,857,870 | A * | 1/1999 | Carter | 439/402 |
| 5,898,381 | A * | 4/1999 | Gartner et al. | 340/815.65 |
| 6,054,932 | A | 4/2000 | Gartner et al. | |
| 6,367,949 | B1 * | 4/2002 | Pederson | 362/240 |
| 6,441,750 | B1 * | 8/2002 | Hutchison | 340/907 |
| 6,466,135 | B1 | 10/2002 | Srivastava et al. | |
| 6,474,839 | B1 | 11/2002 | Hutchison | |
| 6,509,840 | B2 * | 1/2003 | Martineau | 340/815.45 |
| 6,555,958 | B1 | 4/2003 | Srivastava et al. | |
| 6,567,010 | B1 | 5/2003 | Lin et al. | |
| 6,648,495 | B1 * | 11/2003 | Hsu | 362/545 |
| 6,685,339 | B2 * | 2/2004 | Daughtry et al. | 362/249.05 |
| 6,693,556 | B1 * | 2/2004 | Jones et al. | 340/907 |
| 6,717,526 | B2 * | 4/2004 | Martineau et al. | 340/815.45 |
| 6,722,771 | B1 * | 4/2004 | Stephens | 362/184 |
| 6,731,222 | B2 * | 5/2004 | Martineau | 340/815.45 |
| 6,762,689 | B2 * | 7/2004 | Dechape | 340/815.45 |
| 6,943,698 | B2 | 9/2005 | Jones et al. | |
| 6,987,464 | B2 * | 1/2006 | Pearson | 340/902 |
| 6,997,591 | B2 * | 2/2006 | Krumholz | 362/543 |
| 7,102,538 | B2 | 9/2006 | Chen | |
| 7,268,674 | B2 * | 9/2007 | Bohler et al. | 340/426.25 |
| 7,321,191 | B2 | 1/2008 | Setlur et al. | |
| 2004/0036629 | A1 | 2/2004 | Jones et al. | |
| 2006/0039150 | A1 | 2/2006 | Mayer et al. | |
| 2006/0091778 | A1 | 5/2006 | Setlur et al. | |
| 2007/0114562 | A1 | 5/2007 | Radkov et al. | |

FOREIGN PATENT DOCUMENTS

| | | | |
|---|---|---|---|
| EP | 1286321 | A1 | 2/2003 |
| WO | WO0003370 | A1 | 1/2000 |
| WO | WO0189001 | A2 | 11/2001 |
| WO | WO2006050232 | A1 | 5/2006 |
| WO | WO2006132517 | A1 | 12/2006 |
| WO | WO2007062169 | A2 | 5/2007 |

* cited by examiner

*Primary Examiner* — Davetta W Goins
(74) *Attorney, Agent, or Firm* — Fay Sharpe LLP

(57) ABSTRACT

A traffic signal housing includes a bottom housing element that has a radius and a power circuit that is connected to an external source via one or more pluggable connectors through the bottom housing element. Three distinct arrays of LEDs provide a tri-color signal, wherein each array is powered by the power circuit. A distribution cover is coupled to the bottom housing element to enclose the power circuit and the LED arrays.

24 Claims, 3 Drawing Sheets

TRICOLOR SIGNAL HOUSING

BACKGROUND

The present exemplary embodiments relate to signal housings. They find particular application in conjunction with housing multiple LED groups within an automotive, railway, vehicular, waterway, illumination, and/or pedestrian signal. One particular application for such a signal is to substitute three separate and distinct LED groups each in its own housing into a single integrated tri-color signal within one housing. However, it is to be appreciated that the present exemplary embodiment is also amenable to other like applications.

Automotive, railway, vehicular, waterway, illumination, and/or pedestrian signals are employed to regulate motorists and pedestrians via various commands. These commands are provided by various illuminated elements with particular colors and/or shapes that are each associated with an instruction. Elements are conventionally illuminated via incandescent bulbs which use heat caused by an electrical current to emit light. When electrical current passes through a filament (e.g., tungsten), it causes the filament to heat to the point that it glows and gives off light. Such illumination can be covered with a colored lens and/or template to provide a meaningful instruction that can be viewed in a variety of external lighting conditions.

The filament is a resistive element in the incandescent bulb circuit. The amount of current drawn by the filament is proportional to its impedance. This impedance value increases as the temperature of the filament increases. Thus, a conventional lamp has a larger initial current draw which drops in proportion to the increase in the filament impedance. This variation in current draw is known and a predetermined range can be utilized to monitor the lamp operation. As such, a lamp failure condition can be identified based on the amount of current drawn by the filament. In one example, the filament fails (e.g., breaks) causing the impedance approaches an infinite value and the current value decreases to almost zero. If the current drawn is outside of the predetermined range, a responsive action can be initiated by a current monitor or other control system.

Unlike incandescent-based signals, LED-based signals consist of an array of LED elements, which draw much less power. LED-based signals have numerous advantages over incandescent signals, such as greater energy efficiency and a longer lifetime between replacements than conventional signals. However, there are some drawbacks related to current LED signal designs. Three LED signals are generally employed to replace conventional incandescent signals on a one-to-one basis. In addition, current multiple color LED signals are susceptible to color mixing failure due to poor insulation design.

What are needed are systems and methods to provide multi-color signal designs with a single integrated signal that is consolidated into one housing.

BRIEF DESCRIPTION

In one aspect, a traffic signal housing includes a bottom housing element that has a radius and a power circuit that is connected to an external source via one or more pluggable connectors through the bottom housing element. Three distinct arrays of LEDs provide a tri-color signal, wherein each array is powered by the power circuit. A distribution cover is coupled to the bottom housing element to enclose the power circuit and the LED arrays.

In another aspect, a tricolor LED signal housing includes a bottom housing element that has a radius to accommodate one or more traffic signal circuit components on a front side. A plurality of pluggable connectors are permanently built in a back side of the bottom housing element, wherein each pluggable connector accommodates a wire. A power supply PCB includes a plurality of pluggable connectors that are mounted to thereon, wherein each pluggable connector provides direct electrical connectivity from the wire to the power supply PCB. A lighting circuit includes three distinct groups of LEDs in a single array, each group having a disparate color wherein current is drawn by each LED group from the power supply PCB.

In yet another aspect, a method is employed to combine three distinct arrays of LEDs into a single housing. A bottom housing element is assembled to a power/control circuit on a first side, wherein the bottom housing element includes a plurality of pluggable connectors on a second side of the bottom housing element, each pluggable connector accommodates a wire. The power/control circuit is mounted to the bottom housing in a fool-proof manner through the alignment of the pluggable connectors. A single LED PCB, that includes three distinct LED arrays, is connected to the power/control circuit. A distribution cover is coupled to the bottom housing element to enclose the power control circuit and the LED PCB.

DETAILED DESCRIPTION

In describing the various embodiments of the lighting system, like elements of each embodiment are described through the use of the same or similar reference numbers.

Figure 1:
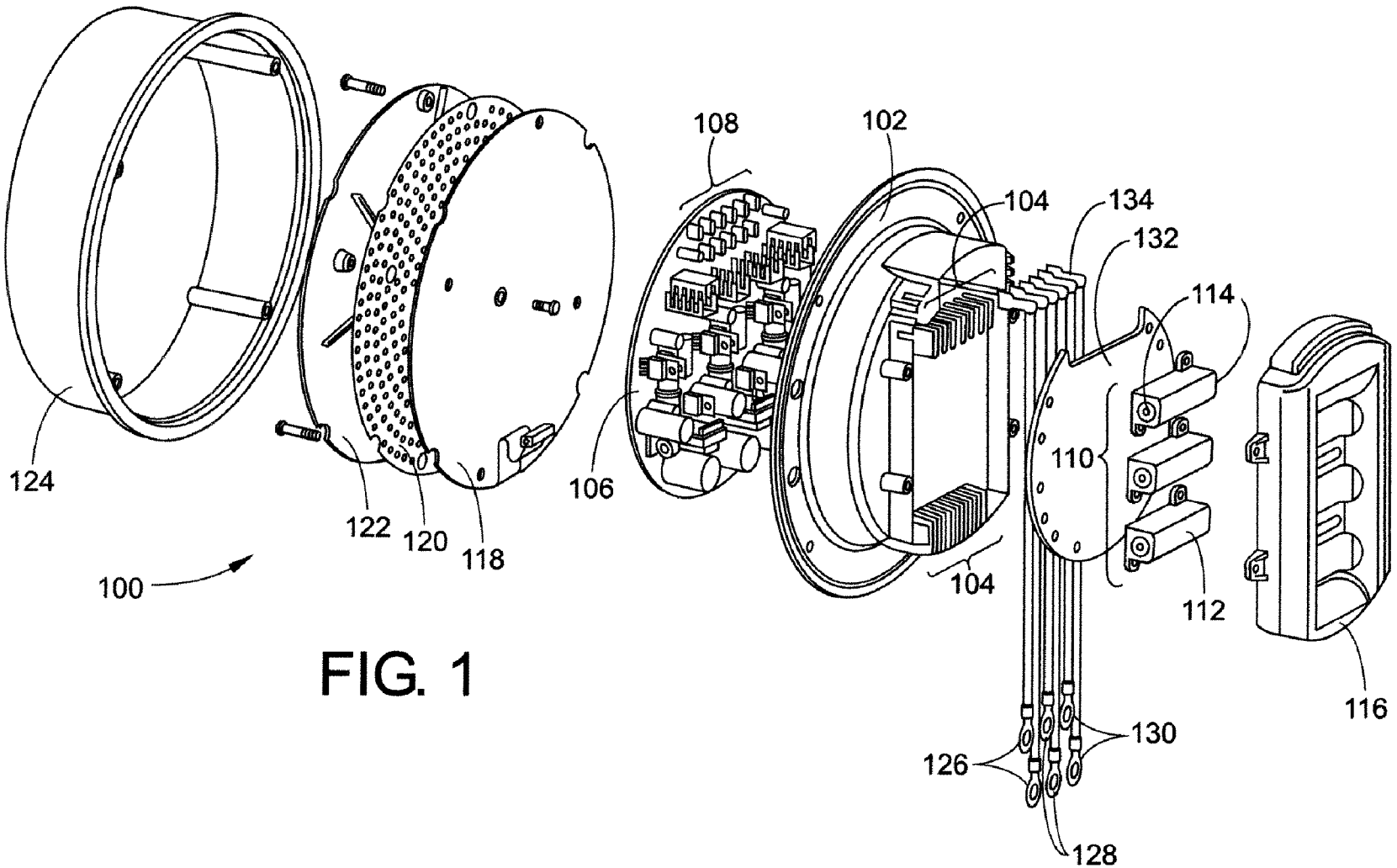
FIG. 1 illustrates a detailed exploded view of a tricolor signal housing, in accordance with an aspect of the subject invention.

FIG. 1 illustrates a detailed exploded view of a tricolor signal housing 100. The tricolor signal housing 100 includes a bottom housing element 102 that is designed to accommodate one or more traffic signal circuits to facilitate power delivery and control to a plurality of illumination elements contained therein. In one approach, the tricolor signal housing 100 is utilized to accommodate an LED traffic signal that includes a plurality of LED groups wherein each LED group is a disparate color. In this manner, a traffic signal can provide necessary disparate light output to provide appropriate traffic (e.g., pedestrian vehicular transit rail, etc.) control.

The bottom housing element 102 includes a plurality of pluggable connectors 104 to facilitate the connection of a plurality of wires to one or more circuits contained inside the tricolor signal housing 100. In one approach, the bottom housing element 102 facilitates electrical connection of wires that deliver power to a plurality of pluggable connectors 108 that are operably connected to a power/control PCB circuit 106 via the pluggable connectors 104.

In one approach, the bottom housing element 102 has a flat bottom and a flared side wall that extends around the circumference of the circular shaped bottom housing element. The side wall profile can include one of a parabolic, an orthogonal, or other shape as desired. Moreover, the diameter and shape of the bottom of the bottom housing element 102 can vary based on the PCB size, LED array size, mask size, lens size, or size of a distribution cover, for example. It is to be appreciated that that size and/or shape of the bottom housing element can vary based on various size or design requirements.

A plurality of dummy loads 110 can be coupled to the power/control PCB circuit 106 to draw additional current into the traffic signal power circuitry. Such additional current draw accommodates legacy control systems which are configured based on such current consumption. Each dummy load 110 includes a body 112 and a pair of terminals 114 to facilitate electrical connection to the power/control PCB circuit 106. A molded dummy load cover 116 can provide a seal over the dummy load terminals 114 to inhibit accidental short-circuits between the electrical connections associated therewith. In addition, the molded dummy load cover 116 can expose the dummy load body 112 to heat dissipation via ambient air.

The power/control PCB circuit 106 is electrically coupled to an LED PCB 118 which is utilized to hold a plurality of LEDs thereon. A mask 120 blocks some of the phantom reflection from the LEDs on the LED PCB 118 via a plurality of individual apertures that correlate one-to-one to the number of LEDs mounted on the LED PCB 118. A lens 122 receives light directed from the LEDs on the LED PCB 118 in order to direct and collimate the light into one or more desired directions. A distribution cover 124 receives light output from the lens 122 to provide a homogenous light distribution to emulate conventional incandescent signal lamps and further reduce the phantom reflections from the signal. In this manner, an LED signal can be substituted for an incandescent signal to provide a lower cost, substantially the same light output.

Generally, retrofitting conventional incandescent traffic signals requires a one-to-one substitution wherein an LED array and corresponding lens and distribution cover are utilized to replace an incandescent lamp for each disparate lamp color. In one example, a conventional traffic signal is comprised of three incandescent lamps that are colored red, yellow and green. A conventional retrofit would replace each incandescent lamp with the appropriate corresponding colored LED array that would be contained in three disparate housings, one for each incandescent signal lamp. In order to provide a more seamless and cost effective solution, all three colors (red, yellow and green) can be utilized with a single LED signal under one housing. This tricolor LED signal contains an LED array that has three disparate groups of LEDs that correspond to the three colors being replaced (e.g., red, yellow, green).

In order to facilitate a single LED array which outputs three disparate colors, the power/control PCB contains three disparate power supply units and three disparate monitoring circuits that correspond to each of the three colors utilized on the LED PCB 118. The power supply unit for each color each utilize an optional dummy load (e.g., resistive element) to increase the current draw of each LED group to emulate the current draw of a conventional incandescent lamp. In order to provide power to each of the power supply units, a pair of wires is utilized to connect the input of the power supply unit to a line voltage.

Additionally, each corresponding dummy load 110 is coupled to the appropriate power supply via a wire pair. Accordingly, in order to accommodate a tricolor signal, a total of six wires is required to provide connectivity to line voltage to each of the three power supply. The bottom housing element 102 includes twelve pluggable connectors 104 wherein the wires can be inserted to electrically connect to twelve pluggable connectors 108 that are mounted on the PCB supply/control circuit. In one approach, the pluggable connectors 104 are permanently built in the back of the housing to create a seal that is water and dust resistant. Moreover, the pluggable connectors 104 simplify assembly of the traffic signal housing 100 when in production.

A conductive plate 132 can be placed between the bottom housing element 102 and the dummy loads 110 to provide a mounting surface thereon. The conductive plate 132 can be utilized to dissipate heat generated by each of the dummy loads 1 10. In one example, the conductive plate 132 is made of aluminum. However substantially any conductive material can be employed. The conductive plate 132 can be mounted to the rear side of the bottom housing element 102 via a plurality of fasteners, such as screws for example. The dummy loads 110 can also all be mounted to the conductive plate 132 via fasteners.

The dummy load cover 116 is mounted to the conductive plate via one or more fasteners (e.g., screws) to cover the terminals at either end of each of the dummy loads 110. The dummy load bodies 112 are passed through the apertures and thereby are exposed to the ambient air to provide additional heat dissipation for the dummy loads 110. Accordingly, the combination of the conductive plate 132 and the exposed dummy load cover 116 provides ample cooling for the dummy loads 110. In this manner, an efficient and simplistic design is utilized to facilitate simple assembly for production of the tricolor signal and corresponding traffic signal housing 100 and further to facilitate straight forward replacement of components when a maintenance issue arises. In one example, the dummy load cover 116 is made of a non-conductive material such as plastic or a similar material.

In one approach, the wires 126, 128, and 130 that deliver power to the tricolor traffic signal 100 can be color coded to avoid erroneous assembly. In one example, a pair of power input wires corresponds to the LED color of each of the LED groups such that a pair of red wires, a pair of yellow wires and a pair of green wires are employed to inform a user (e.g., assembler, maintenance personnel) immediately of which wires provide power to the corresponding light output.

Moreover, each wire can employ a strain relief component 134that mitigates strain placed on the wire pairs 126, 128, 130 when in operation. Such strain relief components 134 can substantially extend the life time of the wires 126, 128, 130 as used in the field. The strain reliefs can mitigate mechanical wear and tear to the electrical connections. Moreover, to facilitate ease of production assembly and replacement in the field, each pluggable connector cavity can be identified via identification engraved in the bottom housing element 102 that states what color each of the pluggable connectors 104 are connected therewith.

Figure 2:
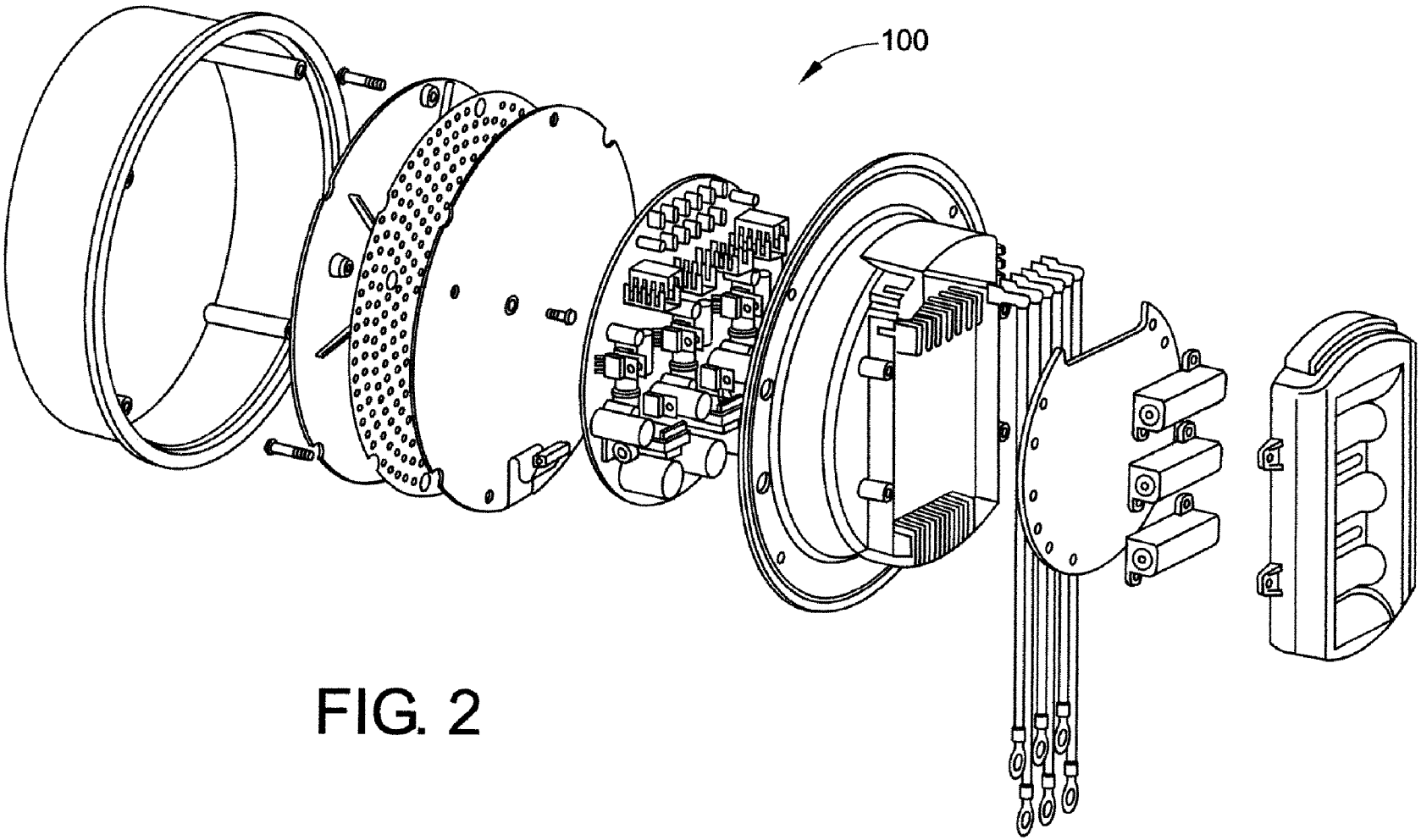
FIG. 2 illustrates an isometric exploded view of a tricolor signal housing, in accordance with an aspect of the subject invention.

FIG. 2 illustrates an isometric exploded view of the traffic signal housing 100. The LED tricolor power signal 100 can be employed to provide control in a wide variety of applications such as a rail wayside signal, a traffic signal, a rail searchlight, and/or one or more transit applications, for example. The LED tricolor signal 100 can include a plurality of benefits over conventional means such as high insulation between power circuits for each LED array, a light output detection, a single input connector (e.g., 12-pin) to provide seamless connection to conventional systems, an optional dummy load, a dummy load detection and a design that meets one or more industry standards, such as a safety integrity level 4.

The LED tricolor signal 100 can be employed to replace three conventional signal heads into a one integrated signal under one housing while maintaining safety and reliability requirements. Three colors can be utilized on a single LED board driven by three disparate power supplies to insure appropriate light output uniformity, fail safe and high insulation between all different colors. In this manner, failure from mechanical vibration is mitigated and cost associated with conventional three head systems is eliminated.

Utilizing the tricolor power signal 100, LED lights for railway signs can be more robust than conventional systems. Moreover, a safer electronic base is employed that is capable of turning off a defective light under a wide variety potential electronic circuit degradation conditions. To provide power to three LED arrays on a single head, three power supplies are employed. Such design can minimize space requirements since only a single head is required. The tricolor power signal 100 can also provide uniformed light intensity and beam angle while eliminating color mixing failure.

The tricolor power signal 100 includes a power supply unit (PSU) 106, an LED light source array 118 and a monitoring circuit. In one embodiment, the PSU 106 is representative of a plurality (e.g., three) power supplies wherein each one drives a particular disparate LED array. The LED array 118 is similarly representative of one or more sets of LEDs that can correlate to the plurality of power supplies represented by the PSU 106.

In one embodiment, the LED array 118 includes a pattern of four columns (one group of four LEDs connected in parallel) by twenty two rows (twenty two groups connected in series) for the Red LEDs, four by thirty-three for the Yellow LEDs and six by fifteen for the Green and White LEDs. In case of an LED failure in a group over the course of operation, the current is redistributed to the other LEDs of the same group and the signal maintains its light output.

Although one embodiment of the LED array 118 is described herein, it is to be appreciated that substantially any number of LEDs, with various colors in disparate configurations can be employed. In one approach, almost four hundred LEDs are arranged and placed on an LED board. However, the circuits described herein can be arranged in substantially any manner utilizing any number or type of components (e.g., surface mount, through-hole, etc.).

Figure 3:
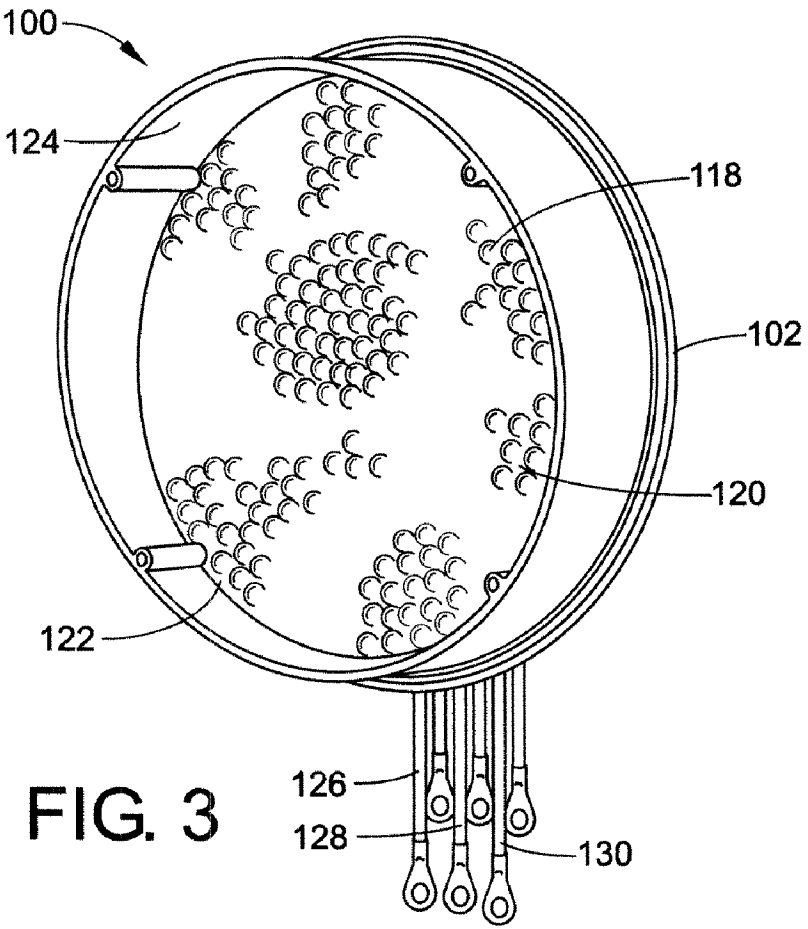
FIG. 3 illustrates a front isometric view of a tricolor signal housing, in accordance with an aspect of the subject invention.

FIG. 3 illustrates a front isometric view of the traffic signal housing 100 which includes a distribution cover 124, the LED array 118, the mask 120 and the lens 122. As shown, the distribution cover 124 is coupled to the bottom housing element 102 to provide a sealed unit to prevent any water or dust from entering the inside of the traffic signal housing 100. As depicted four through ways are utilized with the distribution cover 124 to accommodate a number of screws that are fastened via the rear of the bottom housing element. The wires 126,128,130 are also depicted in disparate colors in association with an aspect of the subject invention.

Figure 4:
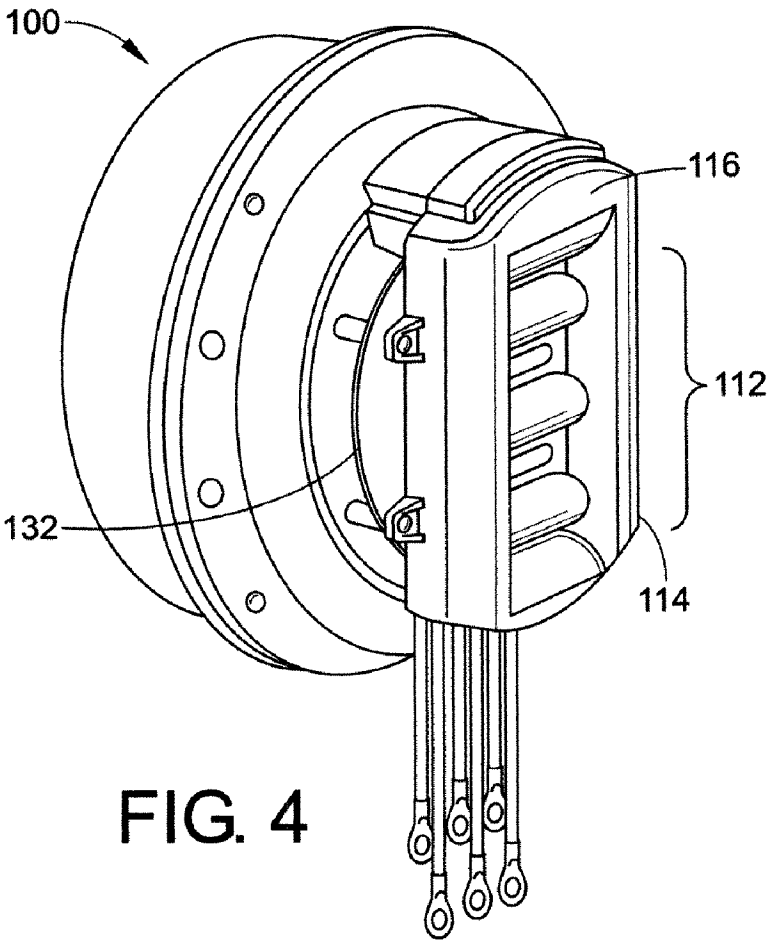
FIG. 4 illustrates a rear isometric view of a tricolor signal housing, in accordance with an aspect of the subject invention.

FIG. 4 illustrates a rear isometric view of the traffic signal housing 100. As shown, the dummy load cover 116 is fastened to the rear of the bottom housing element via four screws through the conductive plate 132. The dummy load bodies 112 are exposed to the ambient air wherein the dummy load terminals 114 are covered via the dummy load cover 116.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A housing for a traffic signal, comprising:

a bottom housing element that accomodates one or more circuits;

a power circuit that is connected to an external source via one or more of a first set of pluggable connectors through the bottom housing element;

three distinct arrays of LEDs that provide a tri-color signal, wherein each array is powered by the power circuit; and a distribution cover that is coupled to the bottom housing element to enclose the power circuit and the LED arrays.

2. The housing according to claim 1, further including:

a plurality of dummy loads that each include a body and a terminal on either end, the dummy loads are mounted externally to the back side of the bottom housing, each dummy load is electrically connected to the PCB circuit via a pair of wires connected to each terminal.

3. The housing according to claim 2, further including:

a dummy load cover that provides a touch-proof seal over the dummy load terminals while substantially exposing the dummy load body to ambient air.

4. The housing according to claim 1, further including:

a second set of pluggable connectors that are permanently built into a back side of the bottom housing element, wherein each of the second set of pluggable connectors accommodates a wire and interfaces to one of the first set of pluggable connectors.

5. The housing according to claim 2, further including:

a conductive plate that is positioned between the bottom housing element and the plurality of dummy loads, wherein the conductive plate dissipates heat generated by the plurality of dummy loads.

6. The housing according to claim 1, further including:

three pairs of wires that couple the power circuit to an external source via the first set of pluggable connectors, wherein a first pair deliver power to the first LED array, a second pair deliver power to the second LED array, and a third pair deliver power to the third LED array, each of the LED arrays emits a disparate color.

7. The housing according to claim 4, wherein the second set of pluggable connectors are grouped and separated by a partition, for easy assembly, inside a recess on the bottom housing.

8. The housing according to claim 4, wherein a label is molded proximate to the second set of pluggable connectors to provide a designation to insure that wires are assembled in an appropriate location.

9. The housing according to claim 1, wherein the LED arrays are all mounted to a PCB.

10. The housing according to claim 9, further including:

a mask that blocks phantom reflection from the LEDs on the LED PCB via a plurality of individual apertures that correlate one-to-one to the number of LEDs mounted on the PCB.

11. The housing according to claim 1, further including:

a lens that directs and collimates light received from the LEDs into one or more desired directions.

12. The housing according to claim 11, wherein the distribution cover receives light output from the lens to provide a homogenous light distribution and reduces phantom reflections from the signal.

13. A tricolor LED signal housing, comprising:

a bottom housing element that accommodates one or more traffic signal circuit components on a front side;

a first set of pluggable connectors that are permanently built in a back side of the bottom housing element, wherein each pluggable connector accommodates a wire;

a power supply PCB that includes a second set of pluggable connectors that are mounted to thereon, wherein each of the second set of pluggable connectors provides direct electrical connectivity from the wire to the power supply PCB; and a lighting circuit that includes three distinct groups of LEDs in a single array, each group having a disparate color wherein current is drawn by each LED group from the power supply PCB.

14. The housing according to claim 13, further including:

a mask that includes a plurality of openings that each correlate to one LED, the mask reduces phantom reflections given off by parts of the LEDs mounted on the lighting circuit.

15. The housing according to claim 14, further including:

a lens that collimates the light output from the mask; and a distribution cover that receives light from the lens, the distribution cover has a geometry and a tint to reduce the phantom reflections given off by the traffic signal.

16. The housing according to claim 13, further including:

three pairs of wires that electrically couple the power/control circuit to an external power source via the first set of pluggable connectors, wherein each wire pair is color coded to correlate to the disparate LED group that receives power therefrom.

17. The housing according to claim 13, further including:

a plurality of dummy loads that each include a body and a terminal on either end, the dummy loads are mounted externally to the back side of the bottom housing, each dummy load is electrically connected to the power supply PCB via a pair of wires connected to each terminal.

18. The housing according to claim 13, further including:

a molded dummy load cover that provides a seal over the dummy load terminals while substantially exposing the dummy load body to ambient air, wherein the dummy load molded cover is made of a non-conductive material.

19. A method of combining three distinct arrays of LEDs into a single housing, comprising:

assembling a bottom housing element to a power/control circuit on a first side, wherein the bottom housing element includes a first set of pluggable connectors on a second side of the bottom housing element, each pluggable connector accommodates a wire;

mounting the power/control circuit to the bottom housing in a fool-proof manner through the alignment of the pluggable connectors;

connecting a single LED PCB that includes three distinct LED arrays to the power/control circuit; and coupling a distribution cover to the bottom housing element to enclose the power control circuit and the LED PCB.

20. The method according to claim 19, further including:

placing one wire into each of the first set of pluggable connectors; and connecting one end of each wire to one of a second set of pluggable connectors mounted to the power/control circuit via the bottom housing element, wherein the second side of the bottom housing element contains an indication proximate to the second set of pluggable connectors to identify the electrical connection associated therewith.

21. An LED signal housing, comprising:

a bottom housing element that accommodates one or more circuit components on a front side;

a first set of pluggable connectors built into a back side of the bottom housing element, wherein each of the first set of pluggable connectors accommodates a wire; and a power supply PCB that includes a second set of pluggable connectors which are mounted thereon, wherein each of the second set of pluggable connectors provides direct electrical connectivity from the wire to the power supply PCB.

22. The LED signal housing according to claim 21, further comprising:

a lighting circuit that includes a plurality of LEDs in an array, wherein current is drawn by the LEDs from the power supply PCB.

23. The LED housing according to claim 21, wherein the second set of pluggable connectors are grouped and separated by a partition, for easy assembly, inside a recess on the bottom housing.

24. The LED signal housing according to claim 21, wherein a label is molded proximate to the second set of pluggable connectors to provide a designation to insure that wires are assembled in an appropriate location.

* * * * *